US005365064A

United States Patent [19]

Rettinghaus

[11] Patent Number: 5,365,064

[45] Date of Patent: Nov. 15, 1994

[54] PROCESS FOR FILTERING ELECTRICALLY CHARGED PARTICLES AND ENERGY FILTER

[75] Inventor: Gerhard Rettinghaus, Balzers, Liechtenstein

[73] Assignee: Balzers Aktiengesellschaft, Balzers, Liechtenstein

[21] Appl. No.: 983,398

[22] Filed: Nov. 30, 1992

[30] Foreign Application Priority Data

Dec. 2, 1991 [CH] Switzerland ..... 3536/91-4

[51] Int. Cl.[5] ..... H01J 47/00; H01J 49/00

[52] U.S. Cl. ..... 250/305

[58] Field of Search ..... 250/305, 292

[56] References Cited

U.S. PATENT DOCUMENTS

| | | | |
|---|---|---|---|
| 3,805,057 | 4/1974 | Yanagisawa | 250/305 |
| 4,126,781 | 11/1978 | Siegel | 250/305 |
| 4,219,730 | 8/1980 | Ishikawa et al. | 250/305 |
| 4,758,722 | 7/1988 | Leckey et al. | 250/305 |
| 4,769,542 | 9/1988 | Rockett | 250/305 |

FOREIGN PATENT DOCUMENTS

| | | |
|---|---|---|
| 0223520 | 5/1987 | European Pat. Off. . |
| 029047 | 3/1989 | U.S.S.R. . |
| 022454 | 3/1990 | U.S.S.R. . |

OTHER PUBLICATIONS

Rev. Sci. Instrum., vol. 44, No. 7, Jul. 1973, pp. 873–876.

*Primary Examiner*—Bruce C. Anderson
*Attorney, Agent, or Firm*—Notaro & Michalos

[57] ABSTRACT

At an energy filter ions are deflected at the entrance side through a first electrostatic field between electrodes (*3a'*, *3b'*), traverse through a field-free volume (15) and enter through a shielding (11) into a further electrostatic deflection field between electrodes (*7a'*, *3b'*). The axes ($A_E$, $A_A$) of the beam entrance and exit are aligned and off-set with respect to the rotation axis ($A'_Z$) of the cylinder forming the outermost electrode (*7a'*).

24 Claims, 8 Drawing Sheets

PROCESS FOR FILTERING ELECTRICALLY CHARGED PARTICLES AND ENERGY FILTER

BACKGROUND OF THE INVENTION

The present invention is related to a filtering technique for electrically charged particles of a particle beam according to their kinetic energy performed by deflection of the trajectory of the beam. The present invention also relates to an energy filter, wherein electrically charged particles of a particle beam are filtered according to their respective kinetic energy by deflecting the propagation path of the beam and is still further related to a combination of such an energy filter with a further filter arrangement, wherein the particles of the beam are filtered according to their mass so as to form an analyser arrangement.

The present invention is further directed on an electron impact ionization source of the kind where neutral particles are ionized by electron impact and further to an analyser with at least such an ion source and a particle energy analyser.

DESCRIPTION OF PRIOR ART

The technique of energy filtering particle beams is customarily used in particular in connection with plasma mass spectrometry. By such known mass spectrometry systems a filter system is formed, wherein a particle selection or filtering is performed on the charged particle of a beam, charged molecules or atomic particles, as a function of their masses and with respect to their transmission through the filtering arrangement.

With respect to the technique of mass spectrometry for plasma analysis, reference is made to the publication "Methods of plasma characterization" by Baizers Aktiengesellschaft, K. Hoefler, BG 800 184 PA (8410), as well as to the publication by the same company, "Partialdruckmessung in der Vakuumtechnik" (Partial pressure measurement in vacuum technology), BG 800 169 PD (8711).

Before a beam of charged particles, a so-called molecular beam, is supplied to a mass spectrometer, it is frequently desired to subject such a beam to energy filtering in order to supply to the mass spectrometer only molecular beam particles of selectively particular kinetic energies, be it within a defined energy band or with energies which do not exceed a given maximum level.

A filtering technique for filtering a beam of electrically charged particles according to their kinetic energy is known from the EP-A-0 223 520. The energy filter technique known therefrom operates based on the principle of the "cylinder mirror". According to this principle the charged particles of a particle beam are led into a volume region with an electric field of a cylinder capacitor and are electrostatically deflected. Such an electrostatic deflection arrangement is often referred to as a "mirror". Thus, in such an arrangement the particles of the beam are mirrored by the cylinder shell forming the external electrode for the generation of the electrostatic field and after passing the said volume region with the deflecting field the particle beam exits again from the cylinder configuration.

The energy filtering effect resides on the fact that particles of higher kinetic energy deflected by a given electrostatic field will propagate along a less curved path than particles of lower energy, so that only particles of a given energy band will propagate through an exit opening, the particles with energies above or below the given energy band being retained within the filter arrangement.

According to the EP-A-0 223 520 which corresponds with the U.S. Pat. No. 4,769,542 which latter is declared in its full extent as an integrated part of the present disclosure by reference, the beam of charged particles is supplied axially to the mirror cylinder configuration and enters into a coaxial opening configuration which is formed by a first pair of electrode surfaces forming a deflection capacitor. These electrode surfaces define a volume region which is curved outwards and wherein, according to the charge polarity and the polarity of the electric field in said capacitor, charged particles are deflected radially outwards. After leaving the curved volume region disposed at the input side, the charged particles enter into the actual mirror volume region of the cylinder mirror, which consists of an inner coaxial electrode core and a coaxial outer shell-electrode. Within the mirror region the charged particles are deflected back and exit into a curved volume region, which latter is arranged symmetrically to the formerly mentioned curved volume region at the input. From the latter curved volume region, wherein the beam is again deflected between two further electrode surfaces, the beam exits along an axis which is aligned with the axis along which the beam enters the filter arrangement.

The radially innermost electrode surfaces of the input deflection arrangement, the innermost electrode surface of the mirror capacitor arrangement as well as the innermost electrode surface of the exit electrode arrangement are formed by one and the same cylinder core. Because all deflection and back deflection are realized by electrostatic fields, i.e. along the curved input volume region, along the actual mirror volume region and along the curved exit volume region, filtering occurs along each of the said volume regions. Particles with too low kinetic energy hit inside the deflected path of the beam on electrode surfaces, particles with too high kinetic energy outside the deflected path of the beam.

In this known filter configuration the electrostatic field, which is generated between the input side electrode pair and which defines the curved input volume region, acts also into the coaxial cylinder-mirror volume region. Due to the resulting superposition of electrostatic fields in the transit area from the input volume region into the cylinder-mirror volume region, which are only hardly predictable, it becomes impossible to control and select the electrostatic fields within adjacent volume regions, independent from each other, i.e. decoupled from each other.

The same conditions prevail in the transition region between the cylinder-mirror volume region and the curved exit volume region. The zones of undefined field patterns in the said transition areas may be deleted by a shield ring, which is operated on the same electric potential as the cylinder core. Between such a shield ring and the outermost cylinder electrode of the mirror cylinder, a significant field is generated, primarily directed in propagation direction of the charged particles, which field aces accelerating or decelerating on the particles of the beam, which action falsifies the characteristic of the filter arrangement.

A similar filtering technique is also known from Soviet Inventions Illustrated, Week 9004, Mar. 7, 1990, No. N90-022454, Derwent Publications Ltd., London, GB, & SU, A, 1 492 397 (AS USSR ANALYT. INST.), Jul. 7, 1989, wherein the coaxial cylinder arrangement comprises an inner cylinder core and an outer cylinder shell. The cylinder core and the cylinder shell are axially separated to form insulated capacitor pairs.

Because two adjacent cylindrical electrode pairs are disposed adjacent each other, the deflecting electrostatic field in one of those axial cylindric capacitor sections may not be set without influencing the field pattern in the adjacent cylindric capacitor section.

Similar techniques are known from Review of Scientific Instruments, Vol. 44, No. 7, July 1973, (New York, US), A. D. McLachlan et al., "A soft X-ray source for photoelectron spectroscopy", pages 873–876, and from Soviet Inventions Illustrated, Week 8905, Mar. 15, 1989, No. N89-029047, Derwent Publications Ltd., London, GB, & SU, A, 1411850 (Volkov), Jul. 23, 1988.

SUMMARY OF THE INVENTION

It is an object of the present invention to realize a process for filtering electrically charged particles of a particle beam according to their kinetic energy, comprising deflecting the beam by applying a first electrostatic field in a first volume region and deflecting it back by applying a second electrostatic field in at least one second volume region, at lease one of preceding and of succeeding the first volume region in direction of beam propagation, wherein improved decoupling of said first and second electrostatic fields is reached, so that said fields may be set substantially independent from each other. This is achieved by shielding the first volume region against the at least one second volume region with respect to electric fields.

By providing such shielding, it is achieved that the electrostatic fields in the said volume regions do not mutually influence each other, so that a setting of the deflecting and back-deflecting fields respectively in their volume regions may be performed decoupled. By this it becomes further possible to adjust filter stages formed along the said volume regions with their respective electrostatic fields, independent from each other.

It is a further object of the present invention to provide said process for filtering to be performed as simply as possible. This is realized by generating the first and second electrostatic fields between respective electrode surfaces and thereby connecting the shielding means to the electric potential of one of the electrode surfaces. By this measure the efforts for additional isolation of the shielding means are omitted.

It is a further object of the present invention to even further improve decoupling between the said first and second electrostatic fields. This is realized by installing a third volume region between the first and the second volume regions and leading the beam through said third volume region and thereby keeping the third volume region substantially free of electrostatic fields.

Although the particles of the particle beam are deflected or back-deflected before entering the said third volume region substantially free of electrostatic fields, such particles will propagate through the said third volume region substantially linearly, so that it becomes possible to control the divergence of the beam in said third volume region by means of appropriately tailoring the field pattern and of appropriate adjustment of the field strength along the volume region through which the beam propagates before entering the third volume region. This because no "noise" deflection field will act along the third volume region. By this measure a controlled optimizing of beam propagation and divergence is considerably simplified.

As it is a further object of the present invention to realize the said process as simply as possible and with fewest possible expenditures for the apparatus performing such process, it is further proposed to generate the second electrostatic field between two electrode surfaces, which have essentially the same curvature with respect to a common center of curvature and thereby performing the shielding by extending that of the two electrode surfaces, which is more distant from the said common center of curvature.

Still in view of the said object of the present invention to simplify the said process and/or to reduce expenditures for implying such process, it is further proposed to generate the first electrostatic field between two electrode surfaces and to perform the shielding by one of the two electrodes generating the first electrostatic field.

Still under this object of the present invention the improved shielding by providing a third volume region substantially free of electrostatic fields is realized in a simple way by enclosing the third volume region predominantly by an extension surface which forms an electrode surface of an electrode for generating the second electrostatic field. Thus, such an extension forms in combination the volume region substantially free of electrostatic fields and one electrode for the second electrostatic field.

It is a further object of the present invention to perform said process so that it may easily be combined with other process stages of a generic analysing process. This is achieved by leading the beam into one of the first and of the second volume regions and leading it out respectively from one of the second and first volume regions, thereby performing deflecting and deflecting back so that leading in of the beam and leading out of the beam is substantially mutually parallel. This allows to perform a generic analysing process with ion generation and/or with additional mass spectrometry, preferably with a quadrupole mass spectrometer, substantially along one common processing axis.

The object of performing the said process so as to enable an overall analysing process with preceding and/or succeeding process stages to be performed as compact as possible is resolved by providing two of the second volume regions respectively preceded and succeeded by first volume regions and performing deflecting and deflecting back so that the beam enters one of the first volume regions and leaves the other of the first volume regions in mutual alignment.

The first mentioned object of the present invention, namely to improve decoupling of electrostatic fields along adjacent filter stages is resolved by the energy filter for filtering electrically charged particles of a particle beam according to their kinetic energy, which comprises a beam entrance arrangement and a beam exit arrangement, at least a first and second pair of capacitor electrodes with electrode surfaces extending substantially in direction of beam propagation between the entrance arrangement and the exit arrangement, whereby the first and second pairs of electrodes are staggered in direction of propagation of the beam between the entrance arrangement and the exit arrangement, and whereby the first and second capacitor electrode pairs respectively generate first and second electric fields directed substantially perpendicularly to the direction of propagation of the beam, the first and second electric fields being mutually inversely poled, and which further comprises electric shield means between a first volume region wherein the first pair of electrodes generates the first electric field and a second volume region wherein the second pair of electrodes generates the second electric field.

It is a further object of the present invention to provide the energy filter with a structure which is as simply as possible. This is achieved by defining with at least one of the first and second pairs of electrodes, first or second volume regions curved substantially around a center of curvature and by realizing the shield means by an extension of that electrode of the pair of electrodes which define the curved volume region, which is disposed more remote from the center of curvature, and by providing at said extension a passage for the beam. Thus, an additional part and additional electric insulating means for the shielding means are omitted.

Under the same object, a further improvement is reached by realizing one of the electrodes of the other of the first and second pairs by the said extension. Thus, this extension does not only form part of an electrode in one volume region, but additionally of an electrode in the other volume region. Thereby, the object is still fulfilled to have electrostatic fields in adjacent deflecting or deflecting back volume regions decoupled, although using the shield forming extension as a common electrode for field generation in adjacent volume regions.

The further object of the present invention, namely to additionally improve decoupling of electrostatic fields in adjacent volume regions, wherein the particle beam is deflected or deflected back, and thereby additionally reaching the advantage of linear beam propagation in a predetermined volume region along the energy filter, is realized by providing a third volume region between the first and the second volume region, which third volume region being predominantly surrounded by electric conductive walls on substantially equal electric potential and being traversed by the beam of charged particles after leaving one of the first and second volume regions and before entering the other of the first and second volume regions. Thereby, for this embodiment, the object of utmost compactness and structural simplification is reached by predominantly forming the wall surrounding the third volume region by an electrode surface of one of the electrodes of the first and second pairs, so that in an optimal compact structure the shield means as well as the wall means as well as a common electrode in the first and in the second volume regions are formed by the same constructive element.

Provision of the third volume region substantially surrounded by conductive walls defines for a volume region which is substantially free of electrostatic fields.

It must be emphasized that due to provision of the third volume region, which is substantially free of electrostatic fields, and thereby the realization of a linear trajectory of the particle beam along a part of the energy filter, the possibility is gained to optimize the trajectory by ion optical measures or by provision of a diaphragm.

Whereas up to now the object of the present invention has been shown to be fulfilled by an inventive energy filter in its minimal configuration, namely with two pairs of capacitor electrodes, by such a minimal configuration the trajectory of the beam through the energy filter may be realized to have mutually parallel input and output axes.

Thus, it is a further object of the present invention to provide the said energy filter so as to enable the axes of input and output to become aligned. This is achieved by the said energy filter comprising two first and two second pairs of capacitor electrodes. Thus, and in contrary to the minimal structure configuration, in this preferred embodiment the trajectory of the beam will not anymore be a S-shaped trajectory, but rather a double S-trajectory or an Ω-shaped trajectory. This especially when two of the first or second electrode pairs are disposed adjacent each other and are in a preferred embodiment formed by a common electrode pair.

An advantage of the known energy filter according to the U.S. Pat. No. 4,769,542 (EP-A-0 223 520), which was discussed in the prior art section of the present application, is its coaxial structure. The input and output deflection electrodes are arranged coaxially to the axis of the cylinder mirror energy filter arrangement with the cylinder capacitor. The particle beam input is split at a sharp pin of the cylinder core forming one of the electrode surfaces and then propagates mirror symmetrically with respect to the axis of the cylindric filter. The pin forms a singularity area and it is known that at such a point or area high field strengths occur.

Particles which arrive exactly on the axis of the filter may not be transmitted through the filler. This is also valid for particles which arrive closely aside the said axis. Further, particles which just may pass the said pin area have unfavourable input parameters with respect to the cylinder mirror.

It has thus been recognized by the inventors of the present invention that such a beam splitting pin is disadvantageous, also because of the high field strength occurring thereat, which unfavorably influences the propagation of the beam which should be as steadily and as controlled as possible.

Thus, it is a further object of the present invention to provide an energy filter, thereby avoiding the disadvantages just mentioned. This is achieved by providing an energy filter for filtering electrically charged particles of a particle beam according to the kinetic energy of the particles, which comprises a cylinder capacitor arrangement for deflecting the beam and an entrance arrangement as well as an exit arrangement for the beam to the cylinder capacitor arrangement, whereby entrance and exit arrangements comprise respectively entrance and exit openings for the beam, which are substantially aligned, and whereby further the cylinder capacitor arrangement defines a propagation path for the beam which is asymmetrical with respect to a cylinder axis of the cylinder capacitor arrangement.

It was recognized that by asymmetric realization of beam propagation path through the energy filter, the energy filter transmission is not lowered, but that unfavourable beam splitting is avoided. In contrary to the known filter arrangement discussed above, particles which impinge in the center of the beam in the energy filter according to the invention are transmitted with especially high transmission rates through the energy filter.

The object of maintaining input axis and output axis of the beam to and from the energy filter mutually parallel or even aligned, is nevertheless reached by off-setting the entrance and exit openings with respect to the axis of the cylinder capacitor arrangement, i.e. by providing the cylinder capacitor arrangement with an outer cylinder, further a capacitor arrangement in a first quadrant of cross-section of the outer cylinder of the capacitor arrangement and the entrance and the exit arrangements in a second quadrant of the said cross-section, opposite the first mentioned quadrant.

Thereby, one should consider that for the constructive implementation of an analyser with an energy filter and possibly with an ion source upstream the energy filter and/or with a quadrupole mass spectrometer downstream the energy filter, it is of predominant importance that the axis of the beam entering and the axis of the beam exiting the energy filter are aligned and to only much lesser extent that those axes are also aligned with the axis of the cylinder condensator.

By the said energy filter with the cylinder capacitor arrangement in one quadrant and the entrance and exit arrangement in another quadrant opposite said first one, additionally the cross-sectional area of the overall cylindric arrangement is better exploited for tailoring the beam propagation path. It goes without saying that the inventive energy filter at which decoupling of the electrostatic fields in adjacent beam deflecting volume regions is achieved, and of the inventive energy filter in cylindric configuration at which the trajectory is asymmetric to the cylinder axis and especially at which the cylinder cross-section is exploited along the two opposite quadrants, may be advantageously combined.

It is a further object of the present invention to improve selective setting of the energy spectrum of particles of a beam led to a mass filter of an analyser arrangement, which is achieved by providing an analyser arrangement, which comprises an energy filter for filtering electrically charged particles of a particle beam according to the kinetic energy of the particles, which energy filter comprises a beam entrance arrangement and a beam exit arrangement, at least a first and a second pair of capacitor electrodes with electrode surfaces extending substantially in direction of beam propagation between the entrance arrangement and the exit arrangement, whereby the first and second pairs of electrodes are staggered in direction of propagation of the beam between the entrance and the exit arrangement, and whereby first and second capacitor electrode pairs respectively generate first and second electric fields directed substantially perpendicularly to the direction of propagation and being mutually inversely poled, and which further comprises electric shield means between a first volume region, wherein the first pair generates said first electric field and the second volume region, wherein said second pair generates the second electric field, and which further comprises a mass filter to filter particles from said particle beam according to their mass, which mass filter is arranged downstream the energy filter.

It is a further object of the present invention provide an electron impact ionization source, by which a neutral particle beam is homogeneously ionized by electron bombardment and which provides for a high rate of ion-exploitation rate. This is achieved by an electron impact ionization source, which comprises an entrance opening predominantly for neutral particles and an exit arrangement predominantly for ions, which entrance arrangement and exit arrangement defining a propagation axis for particles, and which further comprises an acceleration grid tube along the said axis and at least one hot cathode disposed outside the acceleration grid tube. An even improved homogenity of ionization distribution is reached by providing radially outside and around the acceleration grid tube more than one hot cathode.

Looking back to the inventive energy filter, the setting of the electric potential differences to the respective electrode pairs is realized according to the physical rules which are known to the man skilled in the art. The inventive energy filter with decoupled electrostatic fields allows the decoupled setting of its filter stages to result in an extremely narrow banded energy filter. This because, due to shielding of adjacent fields, such adjustment and setting may be performed optimally without that settling of one field would influence the field pattern in the region with the other field. On the other hand, the inventive energy filter, whereat the opposedly located quadrants of a cylindrical arrangement are exploited, allows for an accurate control of beam propagation through the filter, thereby maintaining of the input and output axes of the beam to and from the filter aligned.

As was mentioned, the energy filters under the two aspects of the invention are preferably combined.

BRIEF DESCRIPTION OF THE DRAWINGS

The present invention will be better understood and objects other than those set forth above, will become apparent when consideration is given to the following detailed description thereof. Such description makes reference to the annexed drawings, wherein.

DETAILED DESCRIPTION OF THE INVENTION AND OF BEST MODE OF REALIZATION AND OF PROCESS OPERATION

Figure 1:
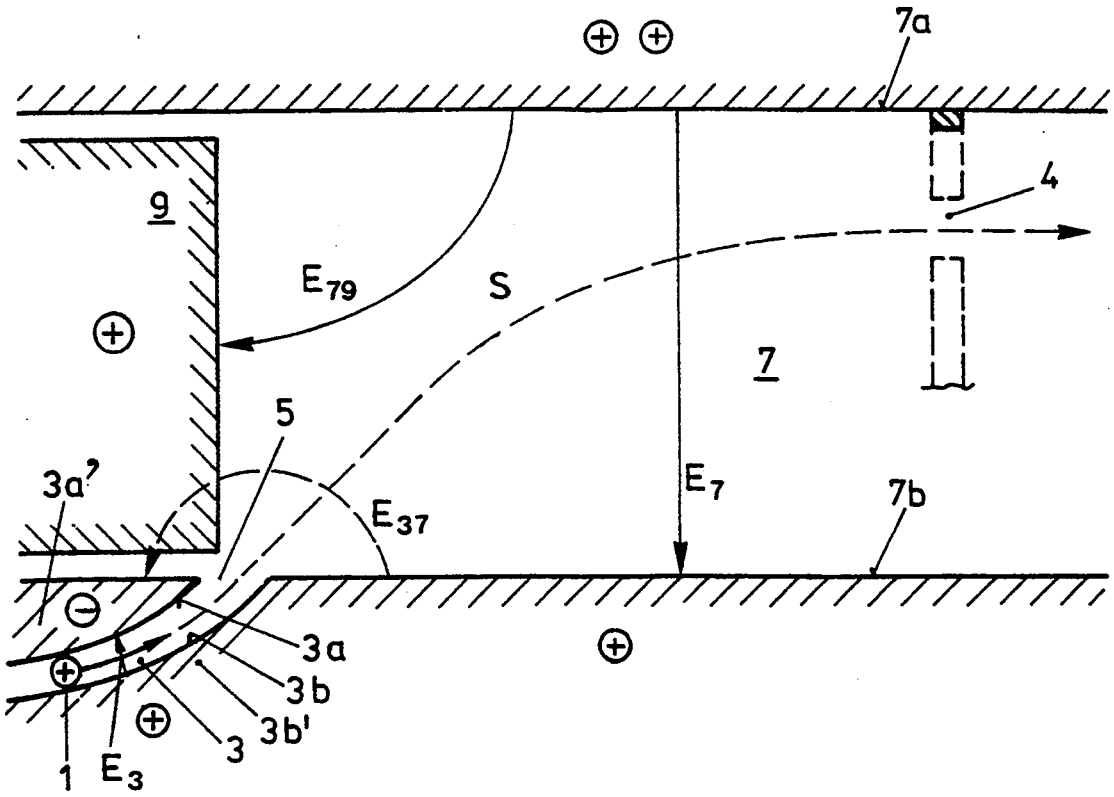
FIG.1 (PRIOR ART)
FIG. 1 shows schematically and in longitudinal section a beam deflection stage of an energy filter according to prior art.

FIG. 1 shows schematically a longitudinal section through a known deflection stage of an energy filter for a beam of charged particles, which is for example known from the EP-A-0 223 520 according to the U.S. Pat. No. 4,769,542. The beam of e.g. positively electrically charged ions 1 enters into a curved volume region 3, which is defined between electrode surfaces 3*a* and 3*b* with essentially equal curvature with respect to a common center of curvature. These electrode surfaces are defined by electrode bodies 3*a*', 3*b*'. By applying a respective electrical potential as schematically shown by + and − to the two electrode surfaces 3*a* and 3*b*, an electrostatic field $E_3$ is generated in the volume region 3, which field extends essentially perpendicularly to the trajectory of the beam S of charged ions 1, which trajectory is drawn qualitatively in dashed lines. By the field $E_3$ the ions are deflected from their original direction of entry into the volume region 3 along this region.

Ions having greater kinetic energy experience in the field $E_3$ a lesser deflection than ions with lower kinetic energy. Consequently, ions of a defined energy band are transmitted through the curved colume region 3, while ions of higher and of lower kinetic energy impinge on one of the two electrode surfaces and are electrically neutralized.

The electrode surface 3*b* on the outside of the curvature, i.e. more remote from the common center of curvature (not shown), is extended in a sharp angle after the exit area 5 of the volume region 3 in downstream direction with respect to beam propagation and forms with this extension an electrode surface 7*b* of a further pair of electrode surfaces, which further pair additionally comprises electrode surface 7*a*. Between the electrode surface pair 7*a*, 7*b*, a further electrostatic field $E_7$ is generated, which is inversely polarized with respect to field $E_3$. By this field $E_7$ the ions are back-deflected, potentially already towards an exit arrangement 4 schematically shown in dashed lines. In the volume region 7, where the field $E_7$ is generated, the ions are more or less deflected back corresponding to their kinetic energy, so that only ions of particular energy band are transmitted through the opening of the exit arrangement 4 and leave the energy filter.

As shown in dashed lines at $E_{37}$ at the exit area 5 of volume region 3, a considerable stray field is formed in the volume region 7 and in this region a superposition of this stray field $E_{37}$ and of primary field $E_7$ occurs, and thus a resulting field, which is a function of $E_7$ as well as of $E_3$. If, as suggested in prior art arrangement, a shield ring 9 is provided and, as further suggested in prior art, placed at the same potential as the electrode surfaces 3*b*, 7*b*, the additional field $E_{79}$ drawn in FIG. 1 results as a function of field $E_7$ and depending on the ion polarity exerts an accelerating or decelerating effect onto the ions propagating in volume region 7. Thus, the trajectory of the ions is falsified in the sense of a poorer energy resolution or transmission.

In the subsequently described embodiments of the invention operating according to the inventive process, the volume regions corresponding to 3 and 7 of FIG. 1, are decoupled with respect to interference of electrostatic fields. Thereby, the disadvantageous interference effects on the beam are avoided and due to the mutual field isolation the electrostatic conditions in both volume regions can be set optimally and independently from one another.

Figure 2:
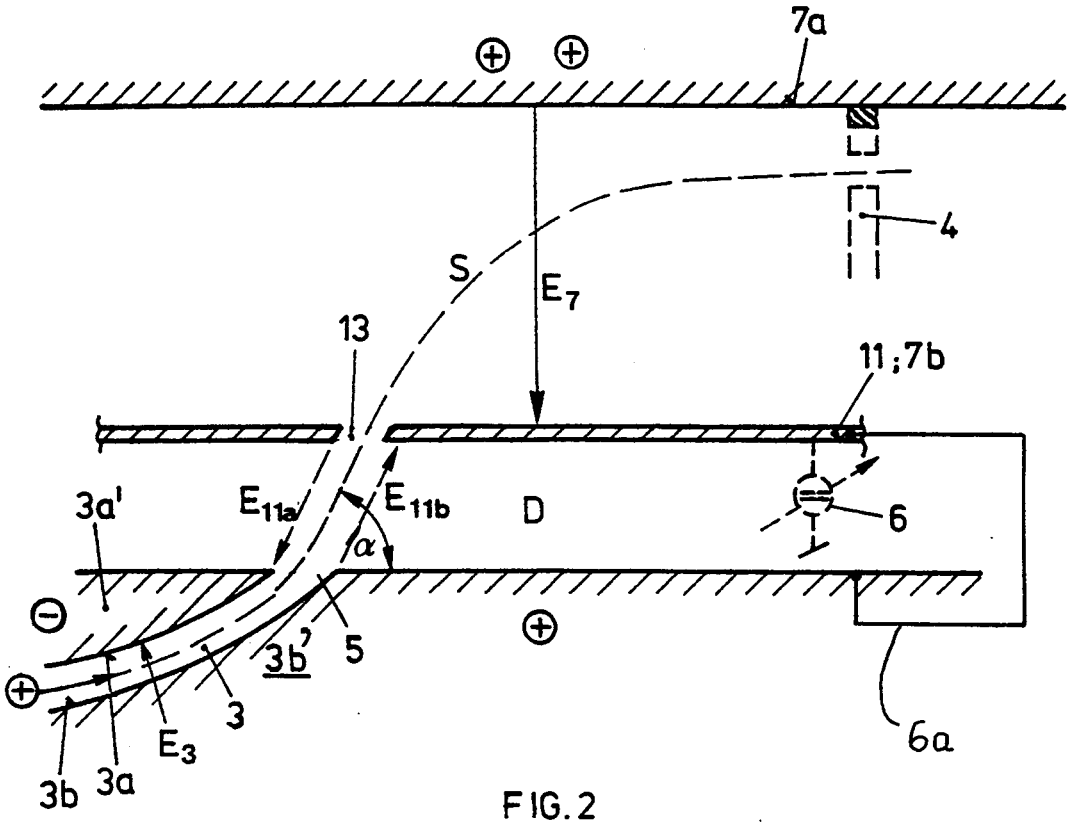
FIG. 2 shows in a representation analogous to that of FIG. 1, an inventive beam deflection stage operating according to the inventive process.

Instead of the particle beam after leaving the curved volume region 3 entering at the exit area 5 directly into the further electric field $E_7$ in volume region 7, inventively a shielding 11 is provided according to FIG. 2, through which the beam S, as shown in dashed lines, penetrates through a slit 13. The electric potential of the shield 11 can be selected, as shown in dashed lines at 6, on any desired value as long as suitable selection is done of the geometric arrangement of shield 11, electrodes 3*a* and 3*b*, so as to keep the influence of the electric field between these three electrodes on the kinetic energy and the deflection of the particles 1 between exit area 5 and slit 13 minimal. This can be realized e.g. by applying to the shield 11 an electrical potential which is at an intermediate value between the values of the potentials of the electrodes 3*a*'and 3*b*'. In the beam trajectory area the resulting fields between the electrodes 11, 3*a*, and 11, 3*b*, respectively, do thus essentially compensate each other as is schematically shown at $E_{11a}$, $E_{11b}$.

Preferably and as shown in FIG. 2 at 6*a*, the shield 11 is set at the electric potential of the electrode at the outside of the curvature, namely electrode 3*b*'. By selection of a preferred injection angle $\alpha$ between 40° and 45°, and thus due to the oblique trajectory of the beam through the intermediate volume region D, the influence of the electrostatic field $E_{11a}$ between shield 11 and the electrode body 3*a*' *becomes negligible.*

The shield 11, as shown in FIG. 2, forms preferably an electrode of electrode pair 7*a*, 7*b*, according to FIG. 1. As is evident, due to providing a shield 11, which is penetrated by the beam, no interference of the fields $E_7$ and $E_3$ results, even if shield 11 is combined with electrode 7*b* for a significant constructional simplification.

Figure 3:
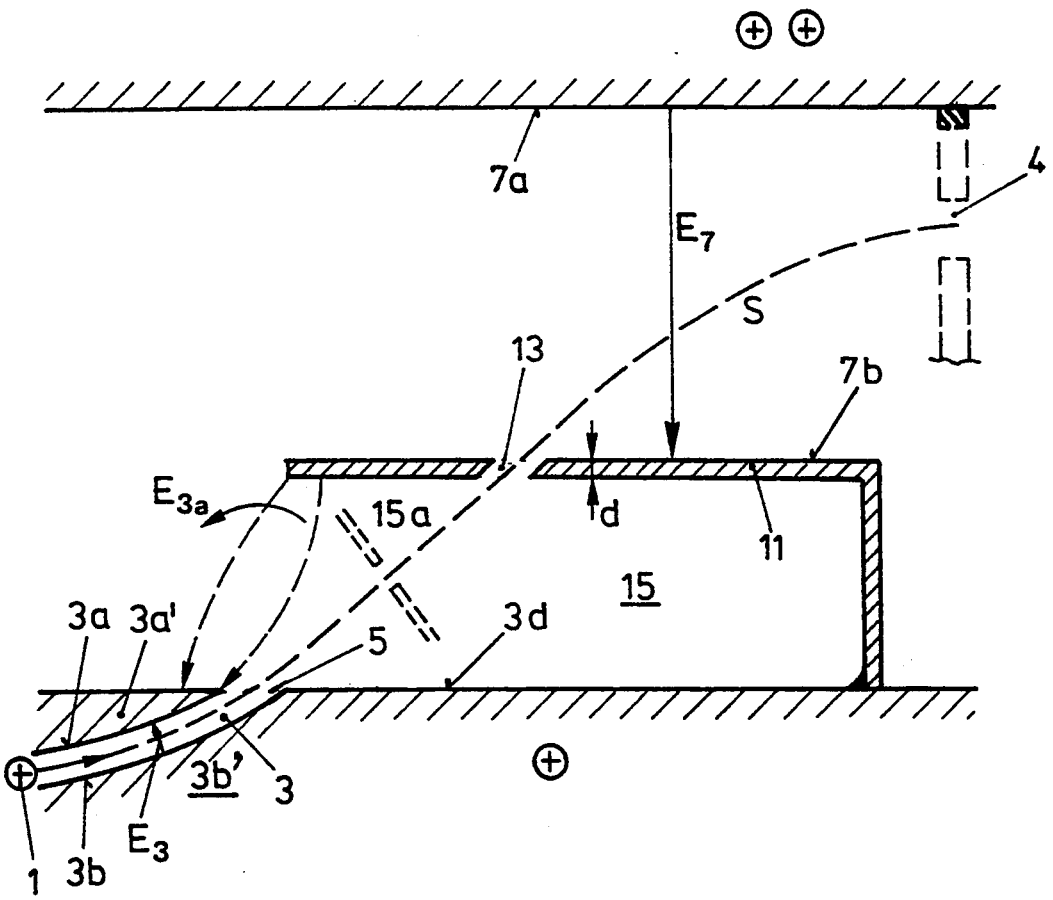
FIG. 3 shows in a representation analogous to that of FIGS. 1 and 2, a further embodiment of an inventive beam deflection stage of an inventive energy filter, which further shows a further realization of the inventive filtering process.

FIG. 3 shows schematically a first improved embodiment of that inventive energy filter, which was discussed in principle in conjunction with FIG. 2. Again, for identical structural parts identical reference numbers are used. As can be seen in this first preferred embodiment, the electrode surface 3*b* at the outside of the curvature of curved volume region 3 or the body 3*b*' defining such electrode surface is extended beyond the electrode surface 3*a* and borders as an extension 3*d* a unique part or made of several parts, a volume region 15, through which the beam traverses obliquely between exit area 5 and slit 13. The walls substantially surrounding the volume region 15 are electrically conductive and thus define an equipotential surface. Stray fields $E_{3a}$ are generated according to dimensioning of the chamber with the volume region 15, and according to the electric potential difference between the electrode surfaces 3*b* and 3*a*, practically only in areas of the volume region 15, through which the beam S does not propagate. Thus, such stray fields $E_{3a}$ do practically not interfere with the beam deflection or the energy of its particles.

Since the bordering walls of the volume region 15 are on one and the same electric potential, the volume region 15 and especially its area, through which the beam S propagates, is essentially free of electrostatic fields. The section of that wall opposite the exit area 5 further forms the electrode surface 7*b* of the electrode surface pair 7*a*, 7*b*, between which the beam of charged particles is back-deflected following the principle of mirroring. Due to provision of the volume region 15 substantially free of electrostatic fields, through which the beam propagates after having left the curved volume region 3, on the one hand the influence of the interfering field developed between shield 11 and electrode body 3*a*', which forms the electrode surface 3*a* is minimized and, on the other hand, such field-free volume region 15 leads to the possibility of optimizing beam propagation, particularly by appropriate implementation of the electrode pair 3*a*', 3*b*', as well as by providing ion optical means or a diaphragm 15a in the field-free volume region 15. By such measures the beam of charged particles is e.g. focused before it enters into the volume region 7 through slit 13. By action of such a diaphragm 15a outer portions of the beam are masked out, considered in cross-section of the beam. Such beam controlling is possible in the field-free volume region without the need to take the interference of electrostatic fields on the beam into account.

Based on ion optical reasons, the smallest diameter of slit 13 is selected at most to be equal to the axial extent of that slit, i.e. of the wall thickness d of shield 11.

Figure 4:
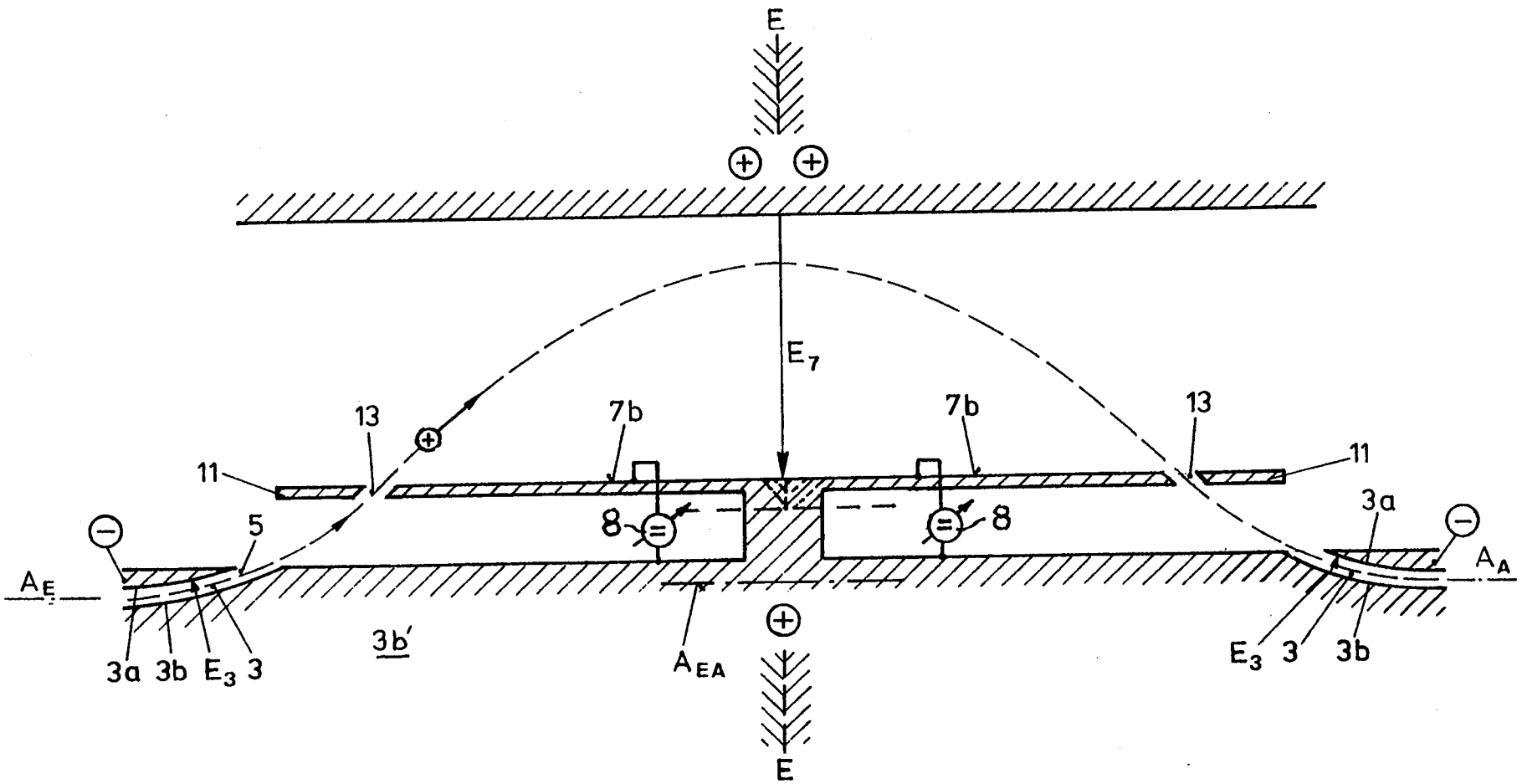
FIG. 4 shows schematically and in a longitudinal section a preferred embodiment of the inventive energy filter and thereby a preferred realization of the inventive filtering process.

In FIG. 4 there is shown a further preferred embodiment of the inventive energy filter and of a preferred processing for filtering. The energy filter according to FIG. 4 is essentially constructed symmetrical to a plane E and is a combination of two configurations of the kind discussed in connection with FIGS. 2 and 3. For identical structural pares or parameters again the same reference numbers are used.

Based on the explanations which were given above and in particular directed to FIG. 3, the structure and function of the preferred embodiment according to FIG. 4 are clearly evident. Again deflection field $E_3$ and back-deflection field $E_7$ for deflecting positive ions are shown. As is evident, the configuration shown in FIG. 4 allows to construe the entrance axis $A_E$ and the exit axis $A_A$ of the beam to and from the energy filter arrangement to be aligned, which is done by accordingly arranging the two curved volume regions 3 at the entrance and the exit arrangements of the filter. Thus, it becomes possible, even without the filter structure being construed in rotational symmetry, to set up a complete analyser equipment with a mass spectrometer downstream the inventive energy filter and in particular a quadrupole mass spectrometer and further, if desired, coupling an ionization source upstream the inventive energy filter to form an inventive analyser for neutral particles construed along a common entrance/exit axis $A_{EA}$. As shown in dashed lines at 8 in FIG. 4, the shields 11 can be made of one or of several parts and may be put on equal electric potential or may be set on different electric potentials which are respectively equal to the potentials of parts 3b' of respective bodies which form with the shield portions 11 considered the respective volume regions substantially free of electrostatic fields.

In FIG. 5 there is again schematically shown an input arrangement of a prior art energy filter, according to the EP-A-0 223 520, which corresponds with the U.S. Pat. No. 4,769,542. This figure shall show the problems which occur at such configuration and form the basis to explain a further improvement of the inventive energy filter and of the inventive filtering process. Again, for identical structural parts and parameters, the same reference numbers have been used.

Figure 5:
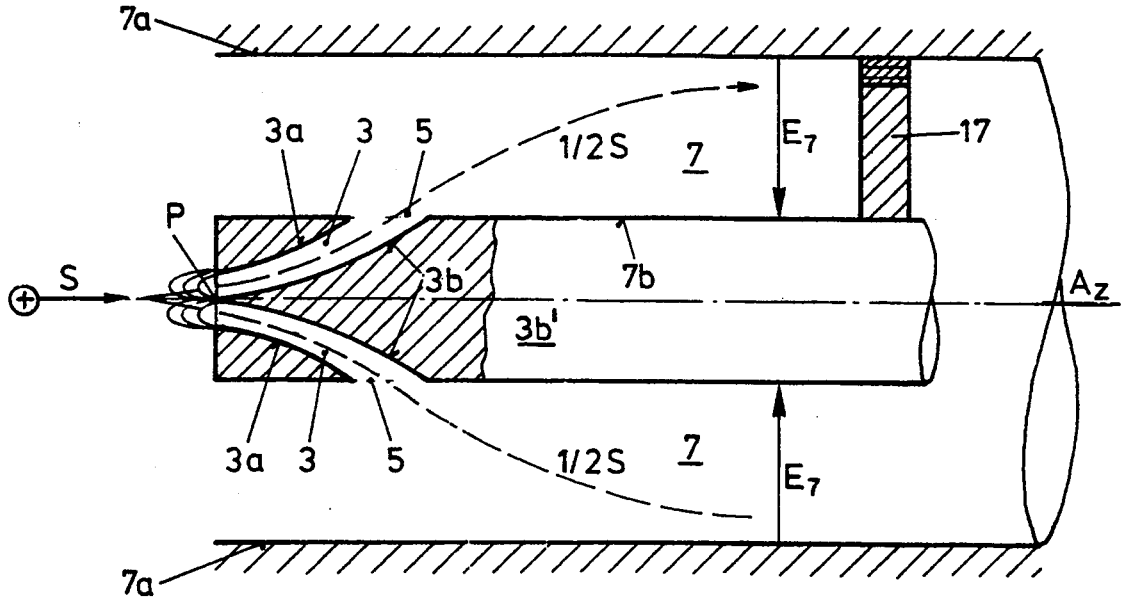
FIG.5 (PRIOR ART)
FIG. 5 shows schematically and in a longitudinal section the input arrangement of a prior art energy filter.

The prior art structure according to FIG. 5 comprises curved volume regions 3, electrode surfaces 3b at the outer side of the curved volume region 3, as well as an electrode pair 7a, 7b, the overall structure being construed coaxially and cylindrical with respect to a cylinder axis $A_Z$. The impinging beam S of charged particles is split at a sharp pin-like point P of an inner cylinder core 3b' which defines for the electrode surfaces 3b and 7b, and which is mounted by radial holding members 17 disposed in the volume region 7, wherein electrostatic field $E_7$ is generated. The trajectory of the beam S is symmetrical to the cylinder axis $A_Z$. Thereby the impinging beam is split at point P which forms a singularity and passes between electrode pairs along the volume region 3 symmetrically with respect to axis $A_Z$. Due to the action of splitting point P ions which impinge along the axis $A_Z$ cannot be transmitted through the filter configuration. This is also valid for ions which are input near to the axis $A_Z$. Ions which can just barely pass aside point P have unfavourable entry parameters with respect to cylinder mirror in volume region 7.

It has further been found that the singularity point at the input arrangement according to FIG. 5 at P and thus any beam splitting has a most disadvantageous effect on the divergence of the beam and its controllability. On the other hand, it is of great advantage in this known configuration of an energy filter that the entrance and the exit axes to and from the energy filter are essentially disposed aligned due to the symmetry of the configuration.

Figure 6:
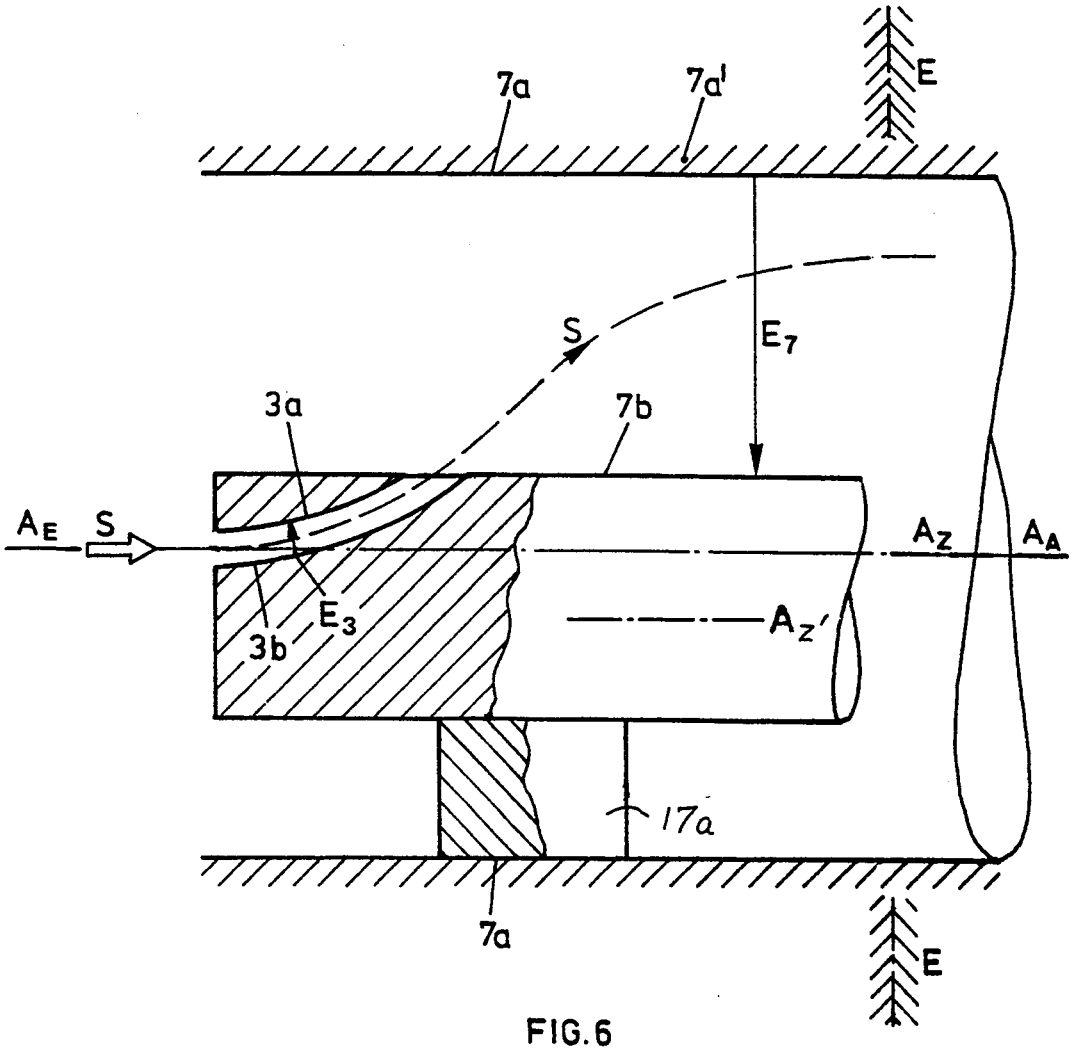
FIG. 6 shows in a representation analogous to that of FIG. 5, the input arrangement of an inventive energy filter.

FIG. 6 shows schematically and in a longitudinal section the input arrangement of an energy filter according to the present invention. The output arrangement, not shown in FIG. 6, results from substantial symmetric construction of the input arrangement shown with respect to the plane E. In this embodiment the entrance or input axis of the beam $A_E$ and the exit axis $A_A$ to and from the energy filter can, as shown, lie on the cylinder axis $A_Z$ of the cylindrical filter design, but, nevertheless, a beam splitting is avoided. Again the same reference numbers are used for parts and parameters described with respect to the previous figures. According to the explanations up to this point with respect to FIG. 6 it becomes already evident that on the one hand the outer boundary of the filter arrangement is essentially given by the outer electrode surface 7a which is cylindrical with cylindrical axis $A_Z$. On the other hand, the beam trajectory within that cylinder is not symmetric with respect to axis $A_Z$. The beam is fed to the energy filter coaxially with axis $A_Z$ and correspondingly leaves the filter along this axis, but there is only one beam trajectory provided and no beam splitting. The asymmetric beam trajectory with respect to the axis $A_Z$ of the cylinder configuration has no negative effect on the characteristic of the filter arrangement compared to a filter arrangement where the beam trajectory propagates symmetrically to that axis, but the former construction results in the advantage that no beam splitting singularity is encountered along the trajectory of the beam.

Further, and as shown in FIG. 5 at 17, holding members for the inner core of the cylinder, which disturb the field patterns in volume region 7, are construed according to FIG. 6 so that such members 17a are not provided in the area of the beam trajectory, but distant therefrom.

Figure 7:
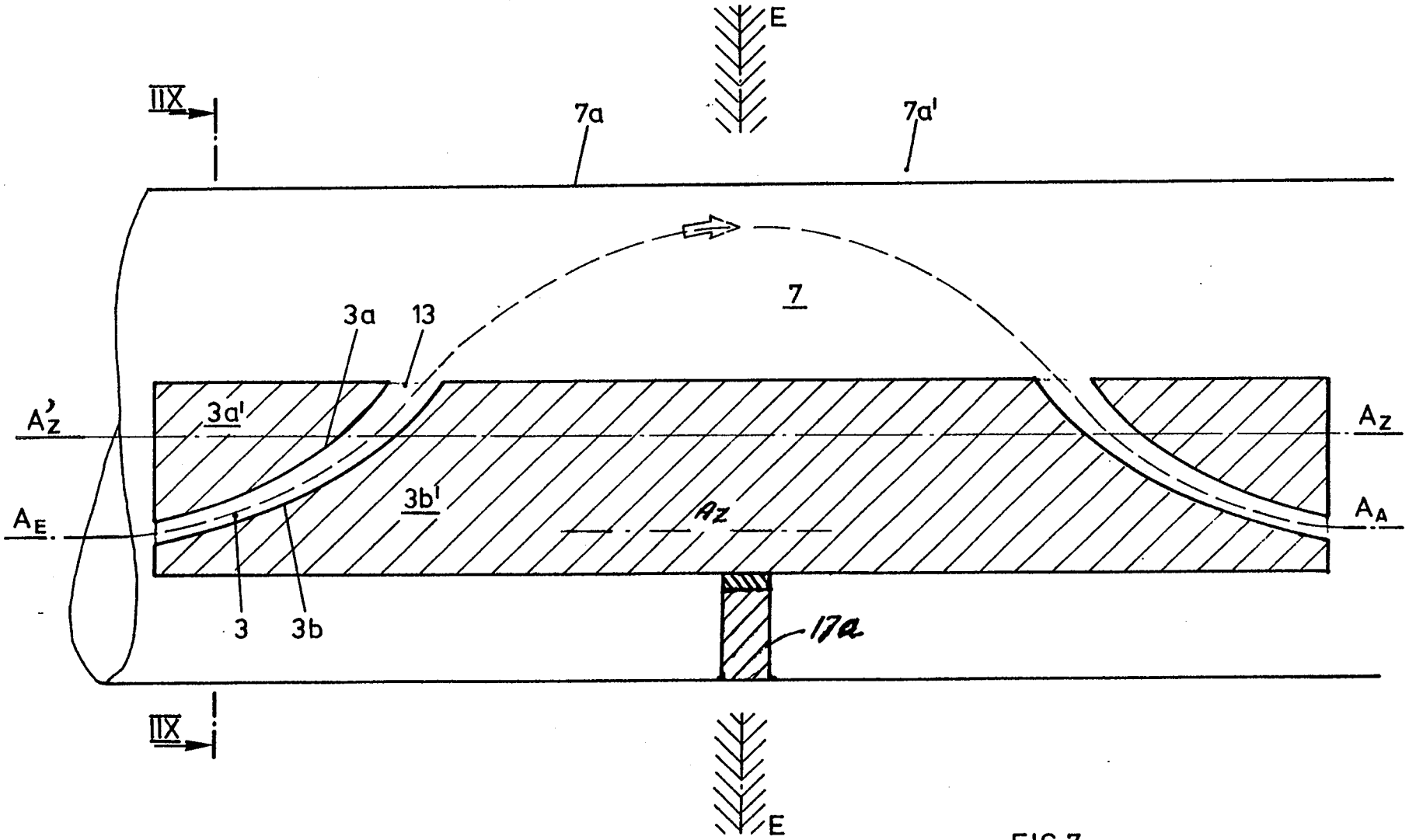
FIG. 7 shows in a representation analogous to that of FIGS. 5 and 6, a preferred embodiment of an inventive energy filter and a preferred realization of the inventive filtering process.

Nevertheless, and as may be seen from FIG. 6, in this embodiment of the invention, in which coaxiality of the filter arrangement of beam input and exit are maintained, the cross-section of the cylindric filter arrangement given by the outer cylinder 7a' is purely exploited. This is improved in a preferred embodiment of the inventive energy filter shown in FIG. 7. Additionally, the embodiment according to FIG. 7 is significantly simpler in terms of fabrication technology. Thereby it has been recognized that keeping on the technology of having the input and output axes of the beam to and from the filter arrangement aligned with its cylindric axis $A_Z$ offers only little advantages for the combination of such a filter arrangement with other stages of an analyser system over a construction where the entrance axis $A_E$ and the exit axis $A_A$ are mutually aligned, but do not lie in the cylinder axis $A_Z$. Thereby, additionally, the cross-section of the cylinder 7a' is significantly better exploited and, as was mentioned, significant advantages are reached in fabrication technology for such a filter.

As is evident from FIG. 7, in which again identical parts and parameters are referred to by the same reference numbers and which has a structure which is substantially symmetrical to plane E in a preferred lay-out, the beam inlet- and the beam outlet-arrangements and -openings are aligned, parallel to the cylinder axis $A_{Z'}$, but are off-set from said axis $A_{Z'}$ so that, if the inlet and outlet openings are provided in a quadrant $Q_1$ of the cross-sectional area of the cylinder, the volume region 7 with back-deflecting electrostatic field is disposed in a quadrant $Q_2$ opposite to the quadrant $Q_1$ with respect to axis $A_{Z'}$. Thus, the cylinder axis $A'_Z$ is displaced with respect to input and output axes $A_E$ and $A_A$ of the beam to and from the filter arrangement.

Figure 8:
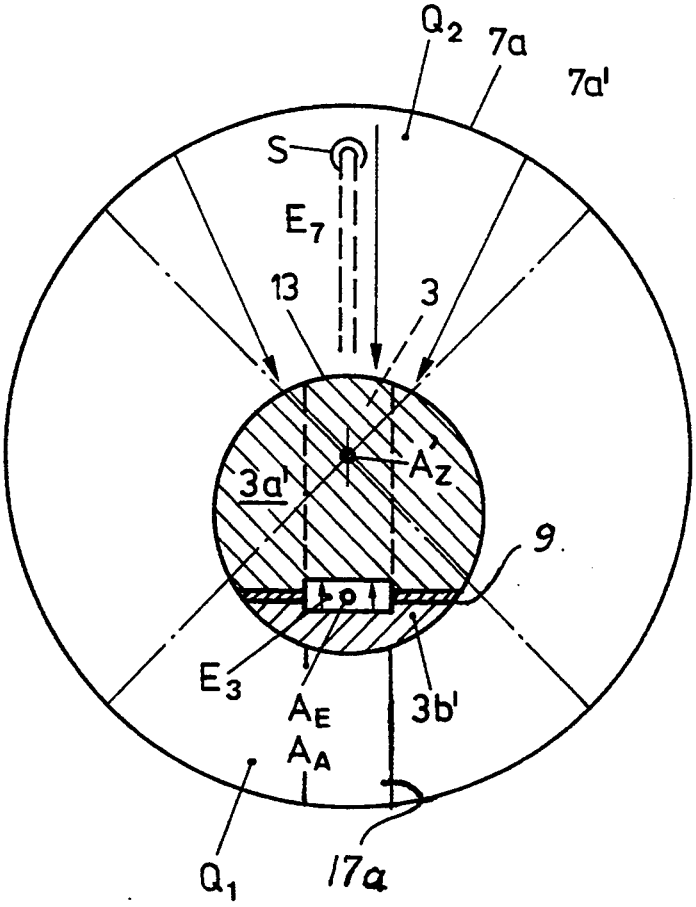
FIG. 8 shows schematically a cross-section along line 8—8 through the energy filter of FIG. 7.

FIG. 8 shows schematically a cross-sectional view along line 8—8 of FIG. 7. The two bodies defining the electrode surfaces 3a or 3b are again referred to by 3a' or 3b' and the quadrants $Q_1$ and $Q_2$ are marked in dot dashed lines. Here the insulation 9 between the body 3a' and 3b' defining the electrode surfaces may be seen, an insulation which is, of course, to be provided in some form or another known to the man skilled in the art, in all embodiments according to the FIGS. 2 to 4, 6 to 7. As becomes evident from FIGS. 7 and 8, the cross-sectional area of the filter cylinder is better exploited than in an embodiment according to FIG. 6.

Figure 9:
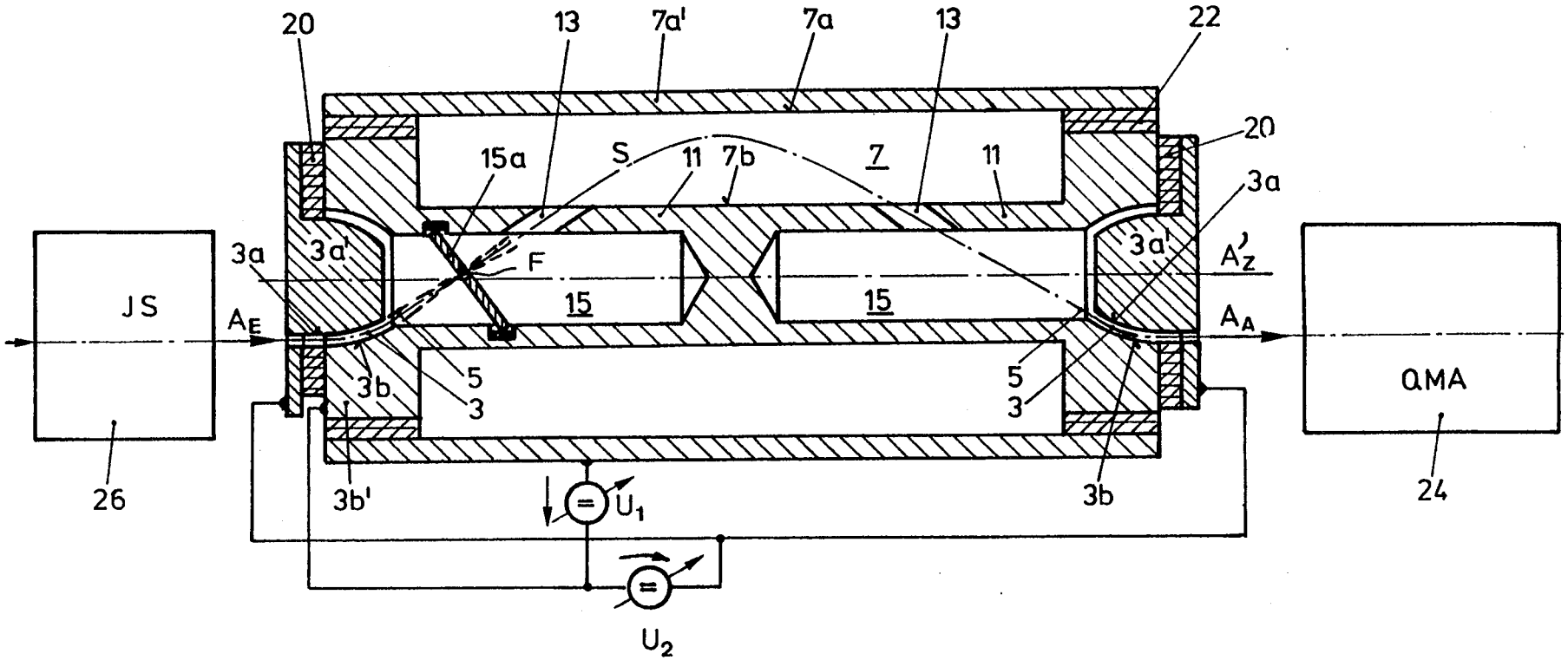
FIG. 9 shows schematically and in longitudinal section the best mode of realization of an inventive energy filter according to the present invention and of filtering processing.

In FIG. 9 the essential parts of the best mode of energy filter according to the present invention and as known to the inventors up to now is shown in a longitudinal schematic section. This figure shows a filter arrangement in which the two inventive aspects of the present invention, namely of providing a shielding between succeeding volume regions with respective beam deflecting electrostatic fields and exploitation of the cylinder mirror principle without beam splitting are combined, the latter with improved exploitation of the cross-sectional area of the mirror filter cylinder. This construction is, in fact, a combination of the schematically shown embodiments of FIG. 4 and of FIG. 7. In order to facilitate cross-comparison, again the same reference numbers are used for the same structural parts and parameters.

The beam S enters along an entrance axis $A_E$ into the curved volume region 3 formed between an electrode surface 3a and the electrode surface 3b. The former electrode surface is defined by an end part 3a' which is rotationally symmetrical to a cylinder axis $A_Z$, the latter electrode surface is defined by a hollow cylinder part 3b', rotationally symmetrical with respect to axis $A_Z$ as well. The previously stated fabrication advantage compared to the embodiment according to FIG. 6 is evident: The electrode surface defining bodies 3a', 3b' are bodies of revolution. The two parts 3a' and 3b' defining the volume region 3 and as shown at 20 are mutually electrically insulated according to insulation 9 of FIG. 8. The direction of exit of beam S from the curved volume region 3 at the exit area 5 is approximately 40° to 45° with respect to the direction of the axis $A_E$ equal to that of $A_Z$. The hollow cylinder 3b' forms the essentially field-free volume region 15 and comprises the slit 13 for the deflected beam S. The mirror cylinder 7a' is mounted electrically insulated from the hollow cylinder 3b', as shown at 22, which mirror cylinder 7a' defines for the electrode surface 7a as a cylinder capacitor electrode surface with respect to the electrode surface 7b of the hollow cylinder 3b'.

The beam outlet arrangement is again provided with a curved volume region 3, which is substantially symmetrical with respect to the volume region 3 at the beam inlet arrangement and with respect to a symmetry plane perpendicular to axis $A_Z$, according to plane E of FIG. 7. The beam exit axis $A_A$ is aligned with the beam entrance axis $A_E$, but both axes are off-set with respect to the axis $A_Z$ of the cylindrical arrangement. For deflecting and back-deflecting the particles of the beam shown as an example as positively charged ions and consequently energy-filtering such particles, the applied differences of electric potential (equivalent to voltage values) are adjustable by voltage sources as shown at $U_1$ and $U_2$ as examples. Thereby both parts 3a' are set as an example on the same potential value, which is, nevertheless, not absolutely necessary. With respect to the potential of part 3a' the hollow cylinder 3b' is set on positive potential, hollow cylinder 3b' which forms the shielding 11, the field-free volume region 15 and one of the electrodes of volume region 7, as well. The outer electrode surface 7a and accordingly the hollow cylinder 7a' is set to a positive potential with respect to the electric potential set to the hollow cylinder 3b'.

In view of the symmetry of the arrangement of FIG. 9, the field which deflects beam S in volume region 7 can be considered a first electrostatic field in a first volume region generated between a first pair of electrodes 7a and 7b, while the beam is deflected in an opposite direction in at least one of two second volume regions 3, 3 which either precede or succeed the first volume region 7 along the propagation path of the beam, or both precede and succeed the first volume region 7, the deflection of the beam in the opposite direction in one or both of regions 3, 3 being achieved by a second electrostatic field generated between the second pair or pairs of electrodes 3a, 3b.

An analyser according to the present invention is formed by combining the inventive energy filter, preferably as shown schematically in FIG. 9, with a mass spectrometer downstream the energy filter, which mass spectrometer is preferably a quadrupole mass spectrometer 24.

If electrically neutral particles are to be analysed in such analyser, the energy filter is preceded by an ionization source, thereby preferably by an electron impact ionization source as shown at 26.

In the field-free volume region 15 there is preferably arranged a beam diaphragm 15a. In this volume region 15 the beam is thus preferably focused on the cross area of the beams trajectory and of the axis $A'_Z$. The diaphragm 15a masks out boundary areas and scattered ions of the beam. At the focus F a crossover of the ion beam results, i.e. the trajectory of ions within the beam cross-over.

It is clearly understood and most familiar to the man skilled in the art, that the analyser stages, i.e. ion source, energy filter and mass filter are operated in vacuum, whereby the particles to be analysed are e.g. extracted from a plasma, this extracting occurring electrostatically for charged particles or by diffusion for neutral particles, which latter being then led into the ionization source 26 for ionization before further analysing.

Figure 10:
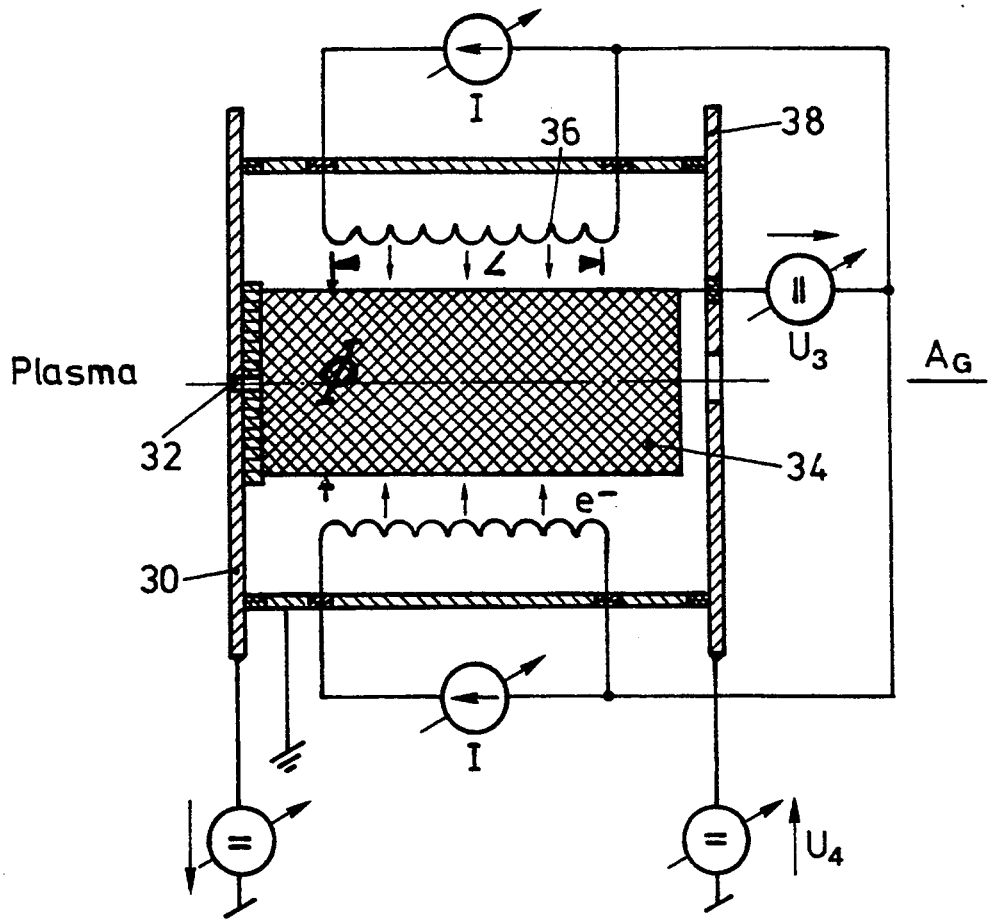
FIG. 10 shows schematically and in longitudinal section an ionization source according to the invention, which is preferably to be combined with the inventive energy filter.

In FIG. 10 an ionization source according to the present invention is schematically shown in a longitudinal section, which is used inventively either per se for any ionization source application, but especially together with the inventive energy filter to form an inventive analyser for neutral particles.

Through a diaphragm 30 with an opening 32, neutral particles are removed from a plasma by diffusion and propagate in an axially expanded cylinder grid 34. At least one electron emitter disposed radially outside the cylinder grid 34 is provided, preferably in the form of at lease one hot emitter cathode 36. Nevertheless, in a preferred embodiment several hot emitter cathodes 36 are provided and azimuthally staggered around grid 34. The electron emitter cathodes 36 are, as shown at $U_3$, set on negative electrical potential with respect to the electric potential of grid 34, so that grid 34 acts as an acceleration grid for the electrons $\bar{e}$ which are emitted by the cathode 36. With the help of current sources 'I' the heating current for the electron emitter cathodes 36 is set and adjusted. The ions generated along and inside the grid 34 through electron impact exit through a further diaphragm 38 which is set at an electric potential as shown by $U_4$ which is as well adjustable. The electric potential of the diaphragm 38 is preferably selected at least substantially equal to the potential of grid 34. Due to the axially expanded grid arrangement and the provision of preferably several and identically acting electron emitters staggered outside and around the grid 34, neutral particles are homogeneously ionised with a high ionization rate. The axial expansion L of the electron current from he electron emitting cathodes, and thus accordingly their axial extent, is preferably selected to be $L \geqq 1.5\Phi$, thereby preferably even to be $L \geqq 3\Phi$, wherein $\Phi$ denotes the diameter of grid 34.

As has been stated, the ionization source according to FIG. 10 is considered inventive per se and is preferably combined with the energy filter according to the preceding figures, in particular with the embodiment according to FIG. 9, in order to form, together with a mass spectrometer succeeding the energy filter, thereby preferably a quadrupole mass spectrometer, an inventive analyser for neutral particles.

While there has been shown and described present preferred embodiments of the invention, it is to be distinctly understood that the invention under all its aspects is not limited thereto, but may De otherwise variously embodied and practised within the scope of the following claims.

I claim:

1. A process for filtering electrically charged particles propagating along a propagation path as a particle beam, according to their kinetic energy, comprising the steps of:

deflecting the beam in one direction by applying a first electrostatic field in a first volume region along said propagation path between a first pair of electrode surfaces;

deflecting said beam in another direction by applying a second electrostatic field between a second pair of electrode surfaces in at least one second volume region which at least one of precedes and succeeds said first volume region along said propagation path, said second pair of electrode surfaces being substantially concentrically bent with respect to a common center of curvature and each being at an electrostatic potential for generating said second electrostatic field;

shielding said first and second electrostatic fields with respect to mutual interference therebetween, by providing a third volume region between wall means held at an equipotential condition, said third volume region being between said first and second volume regions; and operatively connecting the electrostatic potential of said wall means to the electrostatic potential of the one of said second pair of electrode surfaces which is more remote from said center of curvature.

2. The process of claim 1, using said wall means as one of the electrode surfaces of said first pair of electrode surfaces.

3. The process of claim 1, further comprising the steps of leading said beam into one of said first and said second volume regions, leading said beam respectively out from one of said second and said first volume regions, and performing said deflecting in the one and the other directions, so that said leading in of said beam and said leading out of said beam are substantially mutually parallel.

4. The process of claim 1, further comprising the steps of providing two of said second volume regions respectively preceding and succeeding said first volume region and two of said third volume regions, and performing said deflecting in the one and the other directions so that said beam enters one of said second volume regions and leaves the other of said second volume regions in mutual alignment.

5. A process for filtering electrically charged particles propagating along a propagation path as a particle beam, according to their kinetic energy, comprising the steps of:

deflecting the beam in one direction by applying a first electrostatic field in a first volume region along said propagation path between a first pair of electrode surfaces;

deflecting said beam in another direction by applying a second electrostatic field between a second pair of electrode surfaces in at least one second volume region which at least one of the precedes and succeeds said first volume region along said propagation path;

shielding said first and second electrostatic fields with respect to mutual interference therebetween, by providing a third volume region between wall means held at an equipotential condition, said third volume regions being between said first and second volume regions, the wall means substantially surrounding the third volume region and being entirely electrically conductive so that it is at the one electrostatic potential, the third volume region being traversed by the beam along the propagation path after leaving one of the first and second volume regions and before entering the other of said first and second volume regions; and the wall means comprising an extension of one of the second pair of electrode surfaces.

6. An energy filter for filtering electrically charged particles of a particle beam according to the kinetic energy of said particles, comprising:

an entrance arrangement and an exit arrangement for said beam propagating therebetween substantially along a propagation path;

at least a first and a second pair of electrode surfaces, said first and second pairs of electrode surfaces being staggered along said direction between said entrance arrangement and said exit arrangement;

electric supply means connected to the said first and second pairs of electrode surfaces respectively for feeding said surfaces so as to generate respective first and second electric fields respectively directed substantially perpendicularly to said propagation path, said first and second electric fields being mutually inversely poled with respect to said path;

said second pair of electrode surfaces being substantially concentrically bent in a plane containing said path and with respect to a common center of curvature;

wall means at an equipotential condition, defining a no-field volume region transversed by said beam and disposed between said first and said second pair of electrode surfaces along said propagation path; and said wall means being electrostatically connected to that electrode surface of said second pair which is disposed more remote from said center than the other electrode surface of said second pair.

7. The filter of claim 6, wherein said wall means are formed by an extension of the more remote electrode surface.

8. The energy filter of claim 6, wherein one of the electrode surfaces of said first pair is formed by said wall means.

9. The energy filter of claim 6, further comprising within said no-field volume region at least one diaphragm passed by said beam.

10. The energy filter of claim 6, wherein said beam entrance arrangement and aid beam exit arrangement comprise respectively entrance and exit apertures for said beam, which are substantially mutually parallel.

11. The energy filter of claim 10, wherein said entrance and exit apertures are substantially aligned with each other.

12. The energy filter of claim 6, comprising two of said first and two of said second pairs of electrode surfaces.

13. The energy filter of claim 12, wherein the two first pairs of electrode surfaces are disposed one after the other and the electrode surfaces thereof are formed by common electrode surfaces.

14. The energy filter of claim 13, wherein the electrode surfaces of said two second pairs, which are disposed more remote from respective centers of curvature, are formed by a surface of one electrode.

15. The energy filter of claim 13, comprising two of said wall means.

16. The energy filter of claim 6, wherein said first pair of electrode surfaces defines a cylinder arrangement with an axis and wherein said entrance and exit arrangements comprise respectively entrance and exit apertures for said beam, at least one of said entrance and of said exit apertures being remote from said axis.

17. The energy filter of claim 16, wherein said at least one aperture is substantially parallel to said axis.

18. The energy filter of claim 6, wherein said first pair of electrode surfaces defines a cylinder arrangement with an exits and wherein said entrance and said exit arrangements comprise respectively entrance and exit apertures which are aligned with each other.

19. The energy filter of claim 6, forming substantially a cylinder and having in a first quadrant of a cross-section of said cylinder said first pair of electrode surfaces, and in a second quadrant of said cross-section opposite to said first quadrant said second pair.

20. The energy filter of claim 6, comprising an outer cylinder, said entrance arrangement comprising an opening offset from an axis of said cylinder, focusing means being provided to focus said beam entering said entrance arrangement onto an area disposed on the axis of said cylinder.

21. An energy filter for filtering electrically charged particles of a particle beam according to the kinetic energy of said particles, comprising:

an entrance arrangement and an exit arrangement for said beam propagating therebetween substantially along a propagation path;

at least a first and a second pair of electrode surfaces, said first and second pairs of electrode surfaces being staggered along said direction between said entrance arrangement and said exit arrangement;

electric supply means connected to the said first and second pairs of electrode surfaces respectively for feeding said surfaces so as to generate respective first and second electric fields respectively directed substantially perpendicularly to said propagation path, said first and second electric fields being mutually inversely poled with respect to said path;

wall means at an equipotential condition, defining a no-field volume region transversed by said beam and disposed between said first and said second pair of electrode surfaces along said propagation path; and said no-field volume region comprising a third volume region which is substantially surrounded by said wall means which is electrically conductive and at substantially equal electrical potential throughout, said third volume region being traversed by said beam after leaving one of said first and second volumes and before entering of said first and second volume regions, said wall means being substantially formed by an electrode surface of one of said electrodes of said first and second pairs of electrode surfaces.

22. An analyzer arrangement comprising an energy filter for filtering electrically charged particles of a particle beam according to the kinetic energy of said particles, comprising:

an entrance arrangement and an exit arrangement for said beam propagating therebetween substantially in a propagation direction;

at least a first and second pair of electrode surfaces, said first and second pairs of electrode surfaces being staggered along said direction between said entrance arrangement and said exit arrangement, said first and second pairs of electrode surfaces respectively being fed by electric supply means so as to generate first and second electric fields respectively directed substantially perpendicularly to said direction, said first and second electric fields being mutually inversely poled with respect to said direction;

said second pair of electrode surfaces being substantially concentrically bent in a plane containing said beam with respect to a common center of curvature;

wall means at equipotential condition defining a no-field volume region traversed by said beam and disposed between said first and said second pair of electrode surfaces;

said wall means being electrostatically connected to that electrode surface of said second pair which is disposed more remote from said center than the other electrode surface of said second pair;

and succeeding said energy filter a mass selective particle filter.

23. The analyzer of claim 22, wherein said mass selective filter is a quadrupole mass analyzer.

24. The analyzer of claim 22, further comprising an electron impact ionization source with an entrance arrangement predominantly for neutral particles and an exit arrangement predominantly for ions, said arrangement defining a propagation axis and comprising an acceleration grid tube around and along said axis and radially outside said tube at least one hot cathode, said source being disposed upstream of said energy filter.

* * * * *